United States Patent [19]

Bugiel

[11] 4,384,527

[45] May 24, 1983

[54] EXPLOSIVE BODY COMPRISING AN EXPLOSIVE CHARGE IGNITABLE BY FUSE

[75] Inventor: Horst-Georg Bugiel, Bornheim-Merten, Fed. Rep. of Germany

[73] Assignee: Diehl GmbH, Nuremberg, Fed. Rep. of Germany

[21] Appl. No.: 74,804

[22] Filed: Sep. 11, 1979

[30] Foreign Application Priority Data

Sep. 21, 1978 [DE] Fed. Rep. of Germany ..... 2841040

[51] Int. Cl.[3] ..... F42B 1/00

[52] U.S. Cl. ..... 102/309; 102/475; 102/701

[58] Field of Search ..... 102/DIG. 2, 24 HC, 56 SC, 102/305–310, 475, 476

[56] References Cited

U.S. PATENT DOCUMENTS

| | | | |
|---|---|---|---|
| 3,027,838 | 4/1962 | Meddick | 102/56 SC X |
| 3,100,445 | 8/1963 | Poulter | 102/56 SC X |
| 3,276,369 | 10/1966 | Bell | 102/306 |
| 3,358,780 | 12/1967 | Venghiattis | 102/308 |
| 3,561,361 | 2/1971 | Kessenich | 102/24 HC |
| 4,111,126 | 9/1978 | Thomanek | 102/56 SC |
| 4,213,391 | 7/1980 | Drimmer | 102/DIG. 2 |

*Primary Examiner*—Harold J. Tudor

*Attorney, Agent, or Firm*—Laubscher, Philpitt & Laubscher

[57] ABSTRACT

An explosive body having an intensified detonation pressure is disclosed, characterized in that the body includes a main explosive charge and an auxiliary explosive charge. A material is arranged between the charges for transmitting the impact wave from the detonating auxiliary charge to the main charge. Detonation of the main charge is delayed following detonation of the auxiliary charge, whereby the impact wave of the auxiliary charge compresses the explosive of the main charge. Thus, the intensity of the resulting detonation pressure of the main charge is increased.

1 Claim, 2 Drawing Figures

EXPLOSIVE BODY COMPRISING AN EXPLOSIVE CHARGE IGNITABLE BY FUSE

BACKGROUND OF THE INVENTION

The invention refers to an explosive body comprising an explosive arrangement to intensify the detonation pressure.

What is imperative for the effect of a high-explosive substance in many cases is the detonation pressure, if it is intended to either accelerate inert materials or to destroy them by pressure waves. An acceleration of inert materials is taking place with flat cone charges to fire projectiles or to obtain high speeds of splinters as well as with acute-angled hollow charges by accelerating the jet particles. A destruction by pressure waves is realized, on the other hand, for instance with land mines or sea mines.

The detonation pressure $p_D$ results from the following equation:

$$p_D = \rho\left(\frac{\rho'}{\rho} - 1\right) D^2,$$

wherein $\rho$ is the density of the explosive substance, $\rho'$ being the density of the gas behind the detonation front and D being the detonation speed. It is evident from the equation that the detonation pressure and the effect of the explosive body accordingly are dictated greatly by the density and the detonation speed of the explosive substance. When explosive bodies are made by casting or pressing, only a limited density of material can be achieved so that an increase of the detonation pressure by increasing the explosive density in case of the known explosive bodies is only possible up to a limit predetermined by the manufacturing process and by safety requirements. In practice, the highest density values obtainable are not even reached. The explosive bodies contain cracks which do not only reduce density but also entail inhomogenities affecting the efficiency.

SUMMARY OF THE INVENTION

It is the object of the invention to provide an explosive body in which the detonation pressure is strongly increased prior to the detonation by a considerable instantaneous increase of the explosive density.

The object is solved according to the invention in that the explosive charge is divided spatially into a main charge and an auxiliary charge, that there is provided between the main charge and the auxiliary charge a material transmitting the impact wave of the detonating auxiliary charge to the main charge and that the ignition of the main charge is as late as to cause the detonation front of the main charge to follow the impact wave initiated by the detonating auxiliary charge.

Upon igniting the explosive body, there is first a detonation of the auxiliary charge generating a pressure wave which is transmitted to the main charge to propagate therein. The detonation of the main charge is taking place in that the main charge detonation front follows the impact wave caused by the auxiliary charge. Therefore, the explosive of the main charge had been compressed to a great extent at the moment of its detonation by the impact wave of the auxiliary charge so that the resulting density values are extremely high. However, the detonation pressure does not only rise due to the high increase in density of the main charge, but also due to the increased detonation speed D which, in the equation for detonation pressure is reflected as a quadratic factor. By this means, the explosive body causes a detonation pressure which is much higher than that of the known explosives. With explosive bodies of the conventional construction a comparable effect could be only obtained by finding explosive substances having a higher explosion heat.

The increase in density of the explosive body of the invention is realized in that the detonation is performed in the pressure field of the impact wave generated by the auxiliary charge. At that occasion, density is not only increased in the main charge, but at the same time, a flow generated behind the impact front has the effect that the detonation develops as from a moved explosive body thus additionally increasing the impulse on the surface hit by the detonation front.

The ignition of the auxiliary charge and of the main charge staggered in time may be carried out by different ways. It is for instance possible to provide the main charge and the auxiliary charge with independent fuses each and to delay ignition of the fuse of the main charge as compared to the fuse of the auxiliary charge by means of a timing element. The delay may be caused for instance by a relay having a certain time of response. It is important that the detonation front of the main charge does not reach prematurely or outspeed the impact wave caused inside the main charge by the auxiliary charge, to avoid detonating already before the pressure wave has reached the site concerned. It must be also kept in mind that no pressure ignition of the main charge must take place by the impact wave. If necessary, a corresponding damping of the impact wave can take place in the material present between the auxiliary charge and the main charge.

In a preferred embodiment of the invention, an inert material is provided between the main charge and the auxiliary charge, the inert material which may be a metal body, having the object of transmitting the pressure wave from the auxiliary charge to the main charge, and of interrupting the detonation for all that. The main charge may be separated from the auxiliary charge by an explosive substance having a detonation speed inferior to the impact wave speed of the inert material, only the auxiliary charge being fitted with a fuse. The ignition of the total explosive body thus is performed by a sole fuse directly igniting the auxiliary charge. Upon detonating the auxiliary charge, the detonation front is guided by the explosive at a low detonation speed and delayed accordingly, while the impact wave passes relatively quickly through the inert material to subsequently be ahead of the detonation front. As an advantage of the embodiment, only one fuse is required and the necessary delay between impact wave and detonation front is only realized upon ignition. Alternatively, the delay can be also caused by an explosive layer of convenient geometry connecting the auxiliary charge with the main charge.

It is provided in an advantageous development of the invention that the main charge and the auxiliary charge extend more or less in parallel, one common fuse being provided for both charges and the fuse being in direct communication to the auxiliary charge while it is connected with the main charge via an explosive bridge delaying the detonation front. This construction is very suitable for mines.

BRIEF DESCRIPTION OF THE FIGURES

Two embodiments of the invention are explained hereunder with reference to the Figures, by way of examples.

DETAILED DESCRIPTION

Figure 1:
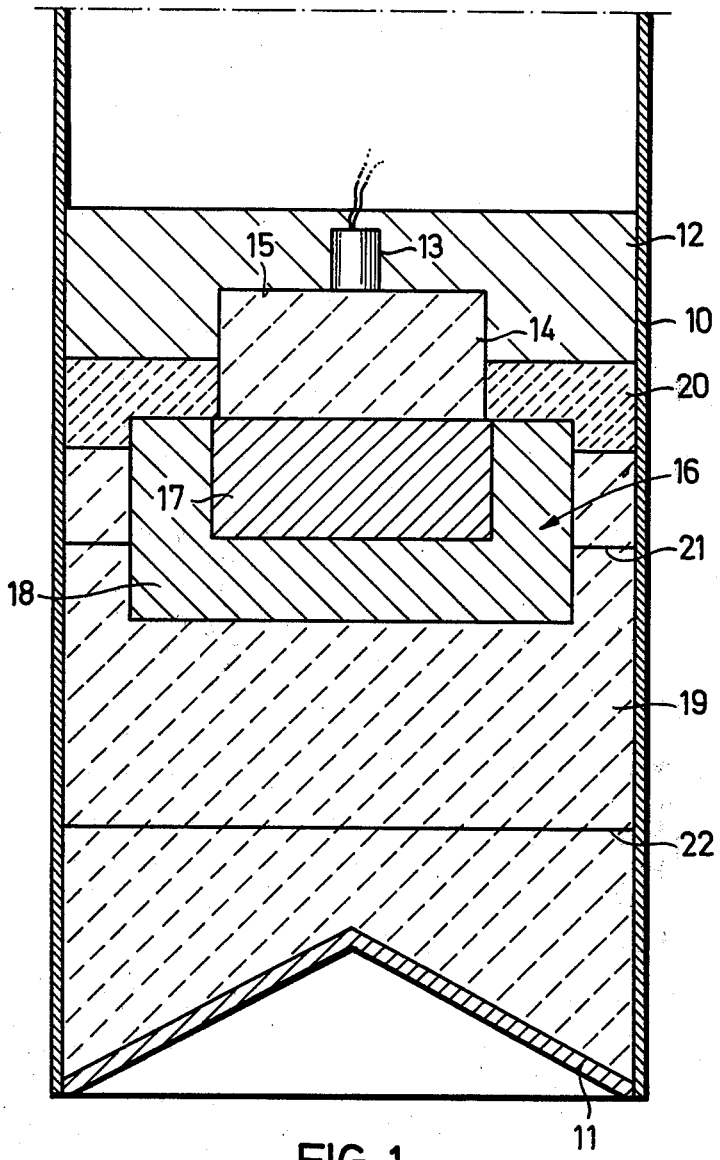
FIG. 1 shows a schematic longitudinal section of part of a hollow charge explosive body and FIG. 2 shows a schematic longitudinal section of the construction of a sea mine.

In the hollow charge explosive body of FIG. 1, the explosive is inside a tube sleeve 10 whose front side is closed by means of a conical metallic hollow space lining 11, the apex of the cone being inward. Inside the tube sleeve 10, there is a damming element 12 which may consist for instance of a metal plate and which contains the fuse 13. The damming element 12 has a central recess 15 for the auxiliary charge 14 to extend therethrough in contact with the fuse 13. At the end remote from the damming member 12, the auxiliary charge 14 fully abuts against a metallic body 16 which is arranged coaxially inside the tube sleeve 10. The metallic body 16 of the instant working example comprises two portions 17 and 18 of which portion 17 rests against the auxiliary charge 14 while all its remaining surface areas are enclosed by portion 18 so that it is inserted into portion 18, its rear face being flush with the latter.

The main charge 19 laterally encompasses the metallic body 16 to fill the interspace between the metallic body 16 and the hollow space lining 11. It consists of one of the customary explosives such as for instance trinitrotoluene, hexogen or octogen.

Between the auxiliary charge 14 and the main charge 19, there is a charge bridge 20 of an explosive having a lower detonation speed of e.g. 2 mm/ns (mm per nanosecond). The charge bridge of the instant working example is annular and in surface contact with the side wall of the auxiliary charge 14 projecting out of the recess 15 and with the rear annular front side of the main charge 19.

Upon igniting the explosive charge by the fuse 13, the auxiliary charge 14 is detonated first. The resulting pressure wave is moving through the metallic body 16 to get into the main charge 19 where it propagates towards the hollow space lining 11. The detonation front originating from the auxiliary charge 14 cannot propagate through the metallic body. Therefore, it is moving to the rearfront side of the main charge 19 via the explosive bridge 20. Due to its slow propagation through the explosive bridge 20, the detonation front is delayed as compared to the pressure wave. In FIG. 1, the detonation front at a specific moment upon igniting the auxiliary charge is designated with 21, while the reference numeral of the pressure wave is 22. It is clearly evident that the detonation front 21 follows the pressure or impact wave 22. The time interval is to be selected so as to enable the impact wave 22 which is introduced via the metallic body 16 into the main charge 19 to reach the hollow space lining 11 earlier than the detonation front 21.

The desired pressure profile of the impact wave 22 can be influenced as required by constructional performances of the damming member 12 which is required anyhow. The detonation front will encounter an explosive dynamically compressed. The higher explosive density of the explosive under impact wave stress of the main charge causes a higher detonation speed. As a result of the increased explosive density and detonation speed, the detonation pressure is higher. In addition, in accordance with the distance to the head of the impact wave, the detonation front is encountering a particle speed generated by the forward impact wave. Due to this effect, it is for instance possible to increase the mass of the hollow space lining 11 in order to produce a longer hollow charge jet with the same jet speed and to increase, accordingly, the penetration of the hollow charge explosive body.

Figure 2:
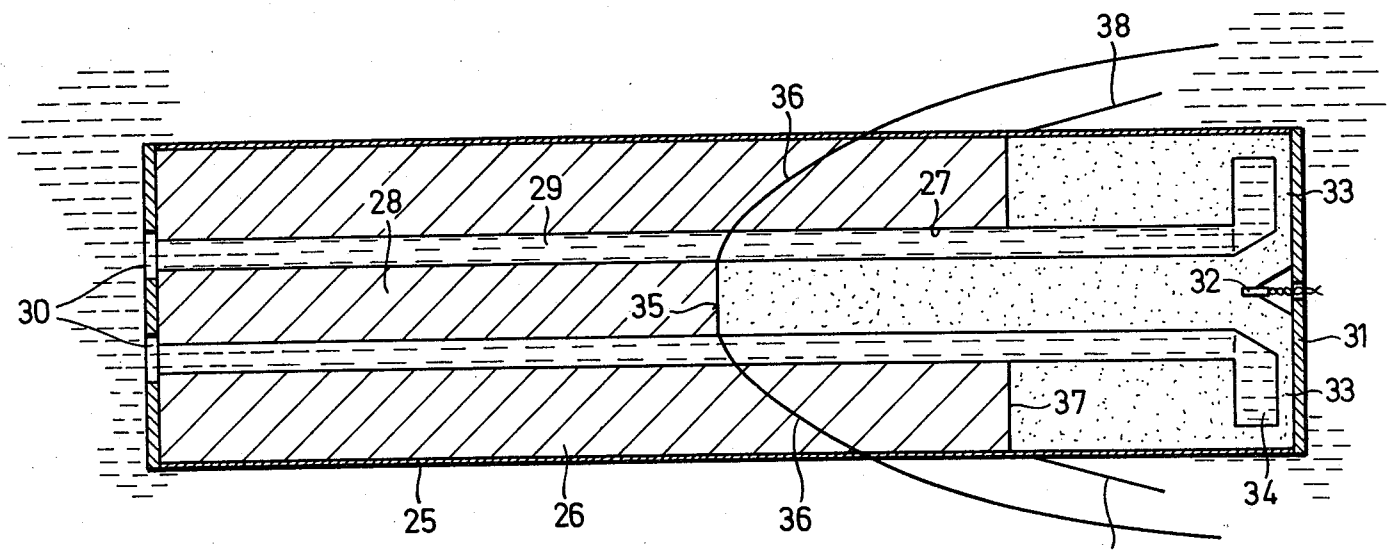

FIG. 2 shows a sea mine having a cylindrical casing or sleeve 25 comprising the hollow cylindrical main charge 26. Inside the longitudinally extending channel 27 of the main charge 26, there is the rod-shaped auxiliary charge 28 extending over the total length of the casing 25. Between the inner wall of the main charge 26 and the outer wall of the auxiliary charge 28, there is an interspace 29 filled with water by means of openings 30 in one of the front sides of the casing. At the opposite front side 31, there is provided a fuse 32 being in direct surface contact with one end of the auxiliary charge 28. A charge bridge 33 extends from fuse 32 along the front side 31 to the end of the main charge 26. An annular interspace 34 taking up water is between the charge bridge 33 and the end of the main charge 26.

Upon igniting the auxiliary charge 28 by the fuse 32, the detonation front 35 is migrating in axial direction along the auxiliary charge. The detonation front 35 induces a pressure wave 36 in the main charge 26 via the hollow space 29 filled with water, which pressure wave, due to the water layer, is as much reduced as to be incapable of igniting the main charge 26.

Due to the detour via the charge bridge 33, the detonation front 37 of the main charge is delayed as compared to the detonation front 35 of the auxiliary charge. As a result, the main charge is continuously compressed in front of the detonation front 37. Hence, the detonation front 37 is propagating in the dynamically compressed explosive of the main charge 26 with a detonation speed increased in correspondence with the increased explosive density. As a result of the increased explosive density and of the increased detonation speed, the detonation pressure is considerably higher.

In FIG. 2, the discharge direction of the gases expanding with the detonation is designated with 38. Moreover, the area of the explosive already converted is unhatched, while the explosive not yet converted is hatched.

By the pressure wave 36, the explosive of the main charge already converted is dammed. Moreover, the explosive particles are accelerated by the pressure wave 36 ahead of the detonation front 37 so that an initial speed is already imparted to them before the detonation.

I claim:

1. An explosive body, comprising (a) a hollow generally cylindrical casing (25);

(b) explosive means arranged within said casing and including (1) an auxiliary explosive charge (28) axially arranged within said casing and extending longitudinally therethrough; and (2) a main explosive charge (26) concentrically arranged in radially spaced relation relative to said auxiliary explosive charge;

(c) fuse means (32) arranged at one end of said casing for igniting said auxiliary explosive charge to produce both a pressure wave and a detonation front;

(d) pressure wave transmission means (29) concentrically arranged between said auxiliary and main explosive charges for transmitting said pressure wave to said main explosive charge while simultaneously impeding said detonation front, said transmission means being spaced from said one end of said casing; and (e) charge bridge means (33) arranged between said auxiliary and main charges adjacent said one end of said casing for transmitting said detonation front to said main explosive charge following transmission of said pressure wave, thereby causing said main explosive charge to have an increased explosive density and thereby intensifying the detonation pressure of the explosive body.

* * * * *